US007642463B2

(12) United States Patent
Guiheen et al.

(10) Patent No.: US 7,642,463 B2
(45) Date of Patent: Jan. 5, 2010

(54) TRANSPARENT CONDUCTORS AND METHODS FOR FABRICATING TRANSPARENT CONDUCTORS

(75) Inventors: James V. Guiheen, Madison, NJ (US); Peter Smith, Long Valley, NJ (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 12/020,689

(22) Filed: Jan. 28, 2008

(65) Prior Publication Data

US 2009/0188697 A1 Jul. 30, 2009

(51) Int. Cl.
*H01B 7/08* (2006.01)

(52) U.S. Cl. ..... 174/117 FF

(58) Field of Classification Search ..... 174/94 R, 174/117 FF, 126.2
See application file for complete search history.

(56) References Cited

U.S. PATENT DOCUMENTS

| | | | |
|---|---|---|---|
| 3,635,870 | A | 1/1972 | Thoma et al. |
| 3,828,218 | A | 8/1974 | Fehnel |
| 4,658,958 | A | 4/1987 | McNulty et al. |
| 5,080,963 | A | 1/1992 | Tatatchuk et al. |
| 5,101,139 | A | 3/1992 | Lechter |
| 5,102,745 | A | 4/1992 | Tarachuck et al. |
| 5,265,273 | A | 11/1993 | Goodwin et al. |
| 5,571,165 | A | 11/1996 | Ferrari |
| 5,576,162 | A | 11/1996 | Papadopoulos |
| 5,578,543 | A | 11/1996 | Tennent et al. |
| 5,614,584 | A | 3/1997 | Schwan et al. |
| 5,707,916 | A | 1/1998 | Snyder et al. |
| 5,752,914 | A | 5/1998 | Delonzor et al. |
| 5,853,877 | A | 12/1998 | Shibuta |
| 5,877,110 | A | 3/1999 | Snyder et al. |
| 6,017,610 | A | 1/2000 | Abe et al. |
| 6,066,448 | A | 5/2000 | Wohlstadter et al. |
| 6,084,007 | A | 7/2000 | Narukawa et al. |
| 6,184,280 | B1 | 2/2001 | Shibuta |
| 6,235,674 | B1 | 5/2001 | Tennent et al. |
| 6,331,265 | B1 | 12/2001 | Dupire et al. |
| 6,630,772 | B1 | 10/2003 | Bower et al. |
| 6,650,679 | B1 | 11/2003 | Bragin et al. |
| 6,752,977 | B2 | 6/2004 | Smalley et al. |
| 6,785,036 | B1 | 8/2004 | Berneth et al. |
| 6,790,526 | B2 | 9/2004 | Vargo et al. |

(Continued)

FOREIGN PATENT DOCUMENTS

| | | | |
|---|---|---|---|
| EP | 0908920 | A2 | 4/1999 |

(Continued)

OTHER PUBLICATIONS

Parekh, B. et al., "Improved conductivity of transparent singlewall carbon nanotube thin films via stable postdeposition functionalization", Applied Physics Letters 90 (12): Art. No. 121913 pp. 1-3 (2007).

(Continued)

*Primary Examiner*—Chau N Nguyen

(57) ABSTRACT

Transparent conductors with nanowires having silver oxide complexes and methods for fabricating such transparent conductors are provided. In one exemplary embodiment, a transparent conductor comprises a substrate and a transparent conductive coating disposed overlying the substrate. The coating comprises silver nanowires at least a portion of which has a silver oxide complex formed on or within surfaces thereof.

11 Claims, 3 Drawing Sheets

U.S. PATENT DOCUMENTS

| | | | |
|---|---|---|---|
| 6,908,572 | B1 | 6/2005 | Derbyshire et al. |
| 6,939,525 | B2 | 9/2005 | Colbert et al. |
| 6,969,504 | B2 | 11/2005 | Smalley et al. |
| 6,988,925 | B2 | 1/2006 | Arthur et al. |
| 7,048,903 | B2 | 5/2006 | Colbert et al. |
| 7,052,666 | B2 | 5/2006 | Colbert et al. |
| 7,060,241 | B2 | 6/2006 | Glatkowski |
| 7,070,754 | B2 | 7/2006 | Smalley et al. |
| 7,105,596 | B2 | 9/2006 | Smalley et al. |
| 7,115,864 | B2 | 10/2006 | Colbert et al. |
| 7,118,693 | B2 | 10/2006 | Glatkowski |
| 7,119,479 | B2 | 10/2006 | Hori et al. |
| 7,195,780 | B2 | 3/2007 | Dennis et al. |
| 2002/0046872 | A1 | 4/2002 | Smalley et al. |
| 2002/0048632 | A1 | 4/2002 | Smalley et al. |
| 2002/0068170 | A1 | 6/2002 | Smalley et al. |
| 2002/0084410 | A1 | 7/2002 | Colbert et al. |
| 2002/0150524 | A1 | 10/2002 | Smalley et al. |
| 2003/0066960 | A1 | 4/2003 | Colbert et al. |
| 2003/0122111 | A1 | 7/2003 | Glatkowski |
| 2003/0158323 | A1 | 8/2003 | Connell et al. |
| 2004/0067329 | A1 | 4/2004 | Okuyama |
| 2004/0099438 | A1 | 5/2004 | Arthur et al. |
| 2004/0116034 | A1 | 6/2004 | Den et al. |
| 2004/0160183 | A1 | 8/2004 | Kim |
| 2004/0186220 | A1 | 9/2004 | Smalley et al. |
| 2004/0197546 | A1 | 10/2004 | Rinzler |
| 2004/0265550 | A1 | 12/2004 | Glatkowski et al. |
| 2005/0074565 | A1 | 4/2005 | Cok |
| 2005/0133779 | A1 | 6/2005 | Choi et al. |
| 2005/0156318 | A1 | 7/2005 | Douglas |
| 2005/0173706 | A1 | 8/2005 | Sasa et al. |
| 2005/0191493 | A1 | 9/2005 | Glatkowski |
| 2005/0195354 | A1 | 9/2005 | Doane et al. |
| 2005/0196707 | A1 | 9/2005 | Cok |
| 2005/0209392 | A1 | 9/2005 | Luo et al. |
| 2005/0221016 | A1 | 10/2005 | Glatkowski et al. |
| 2005/0230560 | A1 | 10/2005 | Glatkowski et al. |
| 2005/0232844 | A1 | 10/2005 | Diner |
| 2005/0236603 | A1 | 10/2005 | Faris |
| 2005/0266162 | A1 | 12/2005 | Luo et al. |
| 2006/0003152 | A1 | 1/2006 | Youngs |
| 2006/0008597 | A1 | 1/2006 | Zagdoun |
| 2006/0054868 | A1 | 3/2006 | Dai |
| 2006/0057290 | A1 | 3/2006 | Glatkowski |
| 2006/0060825 | A1 | 3/2006 | Glatkowski |
| 2006/0062983 | A1 | 3/2006 | Irvin et al. |
| 2006/0065075 | A1 | 3/2006 | Chang et al. |
| 2006/0065902 | A1 | 3/2006 | Todori et al. |
| 2006/0067602 | A1 | 3/2006 | Todori et al. |
| 2006/0068025 | A1 | 3/2006 | Chang et al. |
| 2006/0078705 | A1 | 4/2006 | Glatkowski et al. |
| 2006/0111008 | A1 | 5/2006 | Arthur et al. |
| 2006/0113510 | A1 | 6/2006 | Luo et al. |
| 2006/0188721 | A1 | 8/2006 | Irvin et al. |
| 2006/0188723 | A1 | 8/2006 | Rowley et al. |
| 2006/0257638 | A1 | 11/2006 | Glatkowski et al. |
| 2006/0274047 | A1 | 12/2006 | Spath et al. |
| 2006/0274048 | A1 | 12/2006 | Spath et al. |
| 2006/0274049 | A1 | 12/2006 | Spath et al. |
| 2007/0036978 | A1 | 2/2007 | Chen |
| 2007/0043158 | A1 | 2/2007 | Smalley et al. |
| 2007/0065651 | A1 | 3/2007 | Glatkowski et al. |
| 2007/0065977 | A1 | 3/2007 | Rinzler |
| 2007/0074316 | A1 | 3/2007 | Alden et al. |
| 2007/0116916 | A1 | 5/2007 | Ito et al. |
| 2007/0120095 | A1 | 5/2007 | Gruner |
| 2007/0120100 | A1 | 5/2007 | Glatkowski et al. |
| 2007/0125418 | A1 | 6/2007 | Suzuki et al. |
| 2007/0141345 | A1 | 6/2007 | Rinzler et al. |
| 2007/0152560 | A1 | 7/2007 | Naito et al. |
| 2007/0153353 | A1 | 7/2007 | Gruner |
| 2007/0153363 | A1 | 7/2007 | Gruner |
| 2007/0158642 | A1 | 7/2007 | Gruner |
| 2008/0142823 | A1 * | 6/2008 | Moon et al. ..... 257/98 |

FOREIGN PATENT DOCUMENTS

| | | | |
|---|---|---|---|
| JP | 55043126 | | 3/1980 |
| JP | 56153647 | | 11/1981 |
| JP | 57157218 | | 9/1982 |
| JP | 59190829 | | 10/1984 |
| JP | 59213730 | | 12/1984 |
| JP | 02032845 | | 2/1990 |
| JP | 3045985 | | 2/1991 |
| JP | 9147752 | | 6/1997 |
| JP | 10258486 | | 9/1998 |
| JP | 11026984 | | 1/1999 |
| JP | 2000028825 | | 1/2000 |
| JP | 2000174488 | | 6/2000 |
| JP | 2000252681 | | 9/2000 |
| JP | 2002062404 | | 2/2002 |
| JP | 2004165237 | | 6/2004 |
| JP | 2004253796 | | 9/2004 |
| JP | 2005008893 | | 1/2005 |
| JP | 2005084475 | | 3/2005 |
| JP | 2005268688 | | 9/2005 |
| JP | 200577405 | | 10/2005 |
| JP | 2005317888 | | 11/2005 |
| JP | 2006035773 | | 2/2006 |
| JP | 2006127928 | | 5/2006 |
| JP | 2006133528 | | 5/2006 |
| JP | 2006171336 | | 6/2006 |
| JP | 2006173945 | | 6/2006 |
| JP | 2006191009 | | 7/2006 |
| JP | 2006191010 | | 7/2006 |
| JP | 2006191011 | | 7/2006 |
| JP | 2006191012 | | 7/2006 |
| JP | 2006261322 | | 9/2006 |
| JP | 2006285068 | | 10/2006 |
| JP | 2006324203 | | 11/2006 |
| JP | 2007011997 | | 1/2007 |
| WO | 2004069737 | A2 | 8/2004 |
| WO | 2005012171 | A2 | 2/2005 |
| WO | 2005014184 | A1 | 2/2005 |
| WO | 2005028577 | A2 | 3/2005 |
| WO | 2005086982 | A2 | 9/2005 |
| WO | 2005096338 | A1 | 10/2005 |
| WO | 2005110624 | A2 | 11/2005 |
| WO | 2005114324 | A2 | 12/2005 |
| WO | 2005120823 | A2 | 12/2005 |
| WO | 2006030981 | A1 | 3/2006 |
| WO | 2006073420 | A2 | 7/2006 |
| WO | 2006132254 | A1 | 12/2006 |
| WO | 2007002737 | A1 | 1/2007 |
| WO | 2007004758 | A1 | 1/2007 |
| WO | 2007022226 | A2 | 2/2007 |
| WO | 2007024206 | A2 | 3/2007 |
| WO | 2007035838 | A2 | 3/2007 |
| WO | 2007061428 | A2 | 5/2007 |
| WO | 2007064530 | A1 | 6/2007 |
| WO | 2007/083771 | | 7/2007 |

OTHER PUBLICATIONS

Donner., S., et al., "Fabrication of Optically transparent Carbon Electrodes by the pyroloysis of Photoresist Films", Analytical Chmeistry vol. 78, No. 8, Apr. 15, 2006, pp. 2816-2822.

Watson, K., et al., "Transparent, Flexible, Conductive carbon nanotube coatings for electrostatic charge mitigation", Polymer, 46 (2005), pp. 2076-2085.

Geng, H., et al, "Fabrication of transparent conducting films of carbon nanotubes using spray method", IMID/IDMC '06 digest pp. 525-528 (2006).

Moon, J.S., et al., "Transparent conductive film based on Carbon Nanotubes and PEDOT composites", Diamond and Related Materials 14 (2005), pp. 1882-1887.
Ago, H., et al., "Composites of Carbon Nanotubes and Conjugated Polymers for Photovoltaic Devices", Adv. Mater. 1999, 11 No. 15, pp. 1281-1285.
Kaempgen, M., et al., "Transparent carbon nanotubes coatings", Applied Surface Science 252, (2005) pp. 425-429.
Peltola, J., et al, "Carbon Nanotube Tranparent Electrodes for Flexible Displays", Information Display, Feb. 2007, pp. 20-28.
Wu, Z., et al., "Transparent, conductive carbon nanotube films", Science 305 pp. 1273-1276 (2004).
Ginley, D. et al., "Transparent Conducting Oxides", MRS Bulletin, Vol. 25, No. 8, pp. 15-21, Aug. 2000.
Lewis, B., et al, "Applications and Processing of Transparent Conducting Oxides", MRS Bulletin, vol. 25, No. 8, pp. 22-27, Aug. 2000.
Gordon, R., "Criteria for Choosing Transparent Conductors", MRS Bulletin, vol. 25, No. 8, pp. 52-57, Aug. 2000.
Peng, K. et al., "Morphological selection of electroless metal deposits on silicon in aqueous fluoride solution", Electrochimica Acta 49 (2004) pp. 2563-2568.
Kaempgen, M., et al., "Characterization of Carbon Nanotubes by optical spectra", SyntheticMetals 135-136- (2003) pp. 755-756.
Sun, Y., et al., "Uniform Silver Nanowires Synthesis by Reducing AgNO3 with Etthylene Glycol in Presence of Seeds and Poly (vinyl Pyrrolidone)", Chem Mater. 2002, 14, pp. 4736-4745.
Zhang, M et al., "Strong Transparent Multifunctional Carbon nanotube Sheets", Science (2005) vol. 309, pp. 1215-1219.
Cao, Q, et al. "Highly Bendable, Transparent Thin Film Transistors that use Carbon Nanotube-based Conductors and semiconductors with elastomeric dielectrics", Adv Mater. 2006, 18, pp. 304-309.
Bo, X Z, et al., "Pentacene-carbon nanotubes: Semiconducting assemblies for thin-film transistor applications", Applied Physics Letters 87 (20): Art. No. 203510 pp. 1-3 (2005).
Saran, N., et al., "Fabrication and characterization of thin films of single-walled carbon nanotube bundles on flexible plastic substrates", Journal of the American Chemical Society 126 (14): pp. 4462-4463 (2004).
Hu, L. et al., "Percolation in transparent and conducting carbon nanotubes networks", Nano Letters 4 (12): pp. 2513-2517 (2004).
Unalan, H, et al., "Design criteria for transparent single-wall carbon nanotube thin-film transistors", Nano Letters 6 (4): pp. 677-682 (2006).
Rowell, M., et al., "Organic solar cells with carbon nanotube network electrodes", Applied Physics Letters 88 (23): Art. No. 233506 pp. 1-3 (2006).
Pasquier, A.et al., "Conducting and transparent single-wall carbon nanotube electrodes for polymer-fullerene solar cells", Applied Physics Letters 87 (20): Art. No. 203511 pp. 1-3 (2005).
Aguirre, C., et al., "Carbon nanotube sheets as electrodes in organic light-emitting diodes", Applied Physics Letters 88 (18): Art. No. 183104 pp. 1-3 (2006).
Li, J, et al., "Organic light-emitting diodes having carbon nanotube anodes", Nano Letters 6 (11): pp. 2472-2477 (2006).
Lee, K, et al., "Single wall carbon nanotubes for p-type ohmic contacts to GaN light-emitting diodes", Nano Letters 4(5): pp. 911-914 (2004).
Zhang, D., et al., "Transparent, conductive, and flexible carbon nanotube films and their application in organic light emitting diodes", Nano Letters 6 (9): pp. 1880-1886 (2006).
Artukovic, E, et al., "Transparent and flexible carbon nanotube transistors", Nano Letters 5(4): pp. 757-760 (2005).
Zhou, Y., et al., "p-channel, nchannel thin film transistors and p-n diodes based on single wall carbon nanotube networks", Nano Letters 4(10): pp. 2031-2035 (2004).
Snow, E. et al., "High-mobility carbon-nanotube thin-film transistors on a polymeric substrate", Applied Physics Letters 86 (3): Art. No. 033105 pp. 1-3 (2005).
Snow, E. et al., "Random networks of carbon nanotubes as an electronic material", Applied Physics Letters 82 (13): pp. 2145-2147 (2003).
Seidel, R. et al., "High-current nanotube transistors", Nano Letters 4 (5): pp. 831-834 (2004).
Hur, S. et al., "Printed thin-film transistors and complementary logic gates that use polymer-coated single-walled carbon nanotubes networks", Journal of Applied Physics 98 (11): Art. No. 114302 pp. 1-6 (2005).
Hur, S. et al., "Extreme bendability of single-walled carbon nanotubes networks transferred from high-temperature growth substrates to plastic and their use in thin-film transistors", Applied Physics Letters 86 (24): Art. No. 243502 pp. 1-3 (2005).
Moon, S., et al., 'Transparent conductive film based on Carbon Nanotubes and PEDOT composites', Abstract submited to the Nanotube'05 conference, printed from http://www.fy.chalmers.se/conferences/nt05/abstracts/p214.html on Feb. 15, 2006.
Yu, X ; et al., "Active sound transmission control for windows using carbon nantotube based transparent thin films", printed from URL: www.engineeringvillage2.org.proxy.libraries.rutgers.edu/controller/servlet/Controller on Sep. 12, 2006.
Meitl, M, et al., "Solution casting and transfer printing single-walled carbon nanotube films", Nano Letters 4 (9): pp. 1643-1647 (2004).
Nanotechnology. "How do carbon nanotubes work: carbon nanotube 101." Retrieved on Dec. 6, 2007. Retrieved from Internet: <http://www.nanovip.com/node/2077>.
Tao, A, et al., Langmuir-Blodgett Silver Nanowire Monolayers for Molecular Sensing Using Surface-Enhanced Raman Spectroscopy, Nano Letter, vol. 3, No. 9, 2003, pp. 1229-1233.
Using packed silver nanowires as sensitive explosives detector, UC Berkeley News, Sep. 11, 2003, http://berkeley.edu/news/media/releases/2003/09/11_silver.shtml.

* cited by examiner

TRANSPARENT CONDUCTORS AND METHODS FOR FABRICATING TRANSPARENT CONDUCTORS

FIELD OF THE INVENTION

The present invention generally relates to transparent conductors and methods for fabricating transparent conductors. More particularly, the present invention relates to transparent conductors utilizing silver nanowires combined with compositions of silver oxides and methods for fabricating such transparent conductors.

BACKGROUND OF THE INVENTION

Over the past few years, there has been an increased interest in research and industrial applications for transparent conductors. A transparent conductor typically includes a transparent substrate upon which is disposed a coating or film that is transparent yet electrically conductive. This unique class of conductors is used, or is considered being used, in a variety of applications, such as solar cells, antistatic films, gas sensors, organic light-emitting diodes, liquid crystal and high-definition displays, and electrochromic and smart windows, as well as architectural coatings.

Conventional methods for fabricating transparent conductive coatings on transparent substrates include dry and wet processes. In dry processes, plasma vapor deposition (PVD) (including sputtering, ion plating and vacuum deposition) or chemical vapor deposition (CVD) is used to form a conductive transparent film of a metal oxide, such as indium-tin mixed oxide (ITO), antimony-tin mixed oxide (ATO), fluorine-doped tin oxide (FTO), and aluminum-doped zinc oxide (Al-ZO). The films produced using dry processes have both good transparency and good conductivity. However, these films, particularly ITO, are expensive and require complicated apparatuses that result in poor productivity. Other problems with dry processes include difficult application results when trying to apply these materials to continuous and/or large substrates. In conventional wet processes, conductive coatings are formed using the above-identified electrically conductive powders mixed with liquid additives. In all of these conventional methods using metal oxides and mixed oxides, the materials suffer from supply restriction, lack of spectral uniformity, poor adhesion to substrates, and brittleness.

Alternatives to metal oxides for transparent conductive coatings include conductive components such as, for example, metal nanowires and, in particular, silver nanowires. Transparent conductive coatings formed of such silver nanowires demonstrate transparency and conductivity equal to, if not superior to, those formed of metal oxides. In addition, transparent conductors using such transparent conductive coatings exhibit mechanical durability that metal-oxide transparent conductors do not. Accordingly, these transparent conductors can be used in a variety of applications, including flexible display applications. However, the transparency and conductivity of transparent conductive coatings fabricated using silver nanowires depend on the processes by which the coatings are made. Processes for fabricating transparent conductive coatings with controlled or improved transmissivity and conductivity are in demand.

Accordingly, it is desirable to provide transparent conductors having transparent conductive coatings with improved or controlled transmissivity and conductivity. It also is desirable to provide methods for fabricating such transparent conductors. Furthermore, other desirable features and characteristics of the present invention will become apparent from the subsequent detailed description of the invention and the appended claims, taken in conjunction with the accompanying drawings and this background of the invention.

BRIEF SUMMARY OF THE INVENTION

A transparent conductor in accordance with an exemplary embodiment of the present invention is provided. The transparent conductor comprises a substrate and a transparent conductive coating disposed overlying the substrate. The transparent conductive coating comprises a plurality of silver nanowires, at least a portion of which has a silver oxide complex formed on or within surfaces thereof.

A method for fabricating a transparent conductor is provided in accordance with an exemplary embodiment of the present invention. The method comprises the steps of forming a dispersion comprising a plurality of silver nanowires and a solvent, applying the dispersion to a substrate, and permitting the solvent to at least partially evaporate. The plurality of silver nanowires is oxidized such that a silver oxide complex is formed on or within surfaces of at least a portion of the plurality of silver nanowires.

A method for fabricating a transparent conductor is provided in accordance with another exemplary embodiment of the present invention. The method comprises the steps of providing a substrate and forming a transparent conductive coating comprising silver nanowires overlying the substrate. The silver nanowires have silver oxides on or within surfaces of the silver nanowires.

BRIEF DESCRIPTION OF THE DRAWINGS

The present invention will hereinafter be described in conjunction with the following drawing figures, wherein like numerals denote like elements, and wherein.

DETAILED DESCRIPTION OF THE INVENTION

Figure 1:
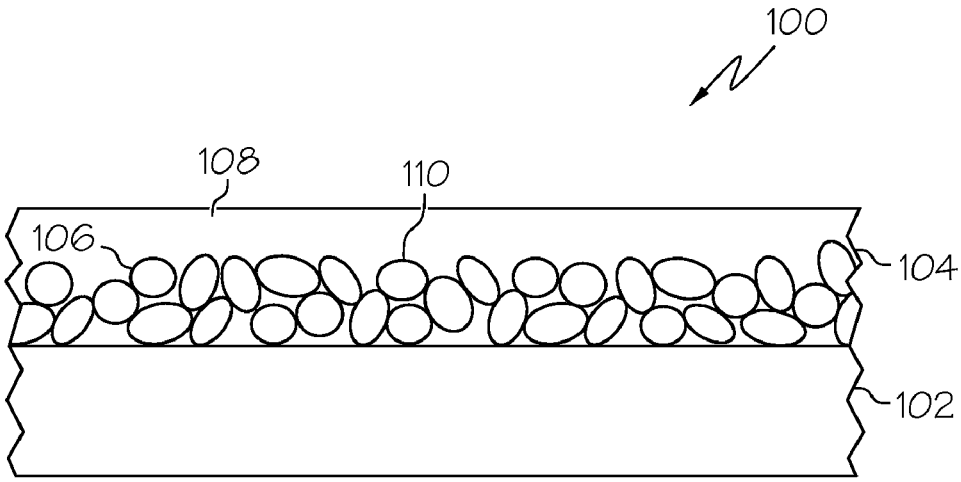
FIG. 1 is a cross-sectional view of a transparent conductor in accordance with an exemplary embodiment of the present invention.

The following detailed description of the invention is merely exemplary in nature and is not intended to limit the invention or the application and uses of the invention. Furthermore, there is no intention to be bound by any theory presented in the preceding background of the invention or the following detailed description of the invention.

Transparent conductors described herein have transparent conductive coatings comprising silver nanowires (AgNWs), which under appropriate conditions may be oxidized. The inventors have found that, by modifying the surface of the AgNWs with silver oxides, transparent conductive coatings, and hence transparent conductors, with improved transmissivity and conductivity can be achieved.

The inventors have also found that, by modifying the surface of the AgNWs with silver oxides present in a predetermined ratio, the transmissivity and the reflectivity of a transparent conductive coating may be improved. An optical material's transmissivity and reflectivity are related to its refractive index. The absorption and refraction of a material, related to its transmissivity, can be described by a single quantity called the complex refractive index ($n_c$), described by equation (1):

$$n_c = n - i \cdot k \quad (1),$$

where "n" is the real part of the complex refractive index, also known as the refractive index, "k" is the imaginary part of the complex refractive index, also known more commonly as the extinction coefficient or absorption coefficient, and "i" is the positive square root of negative one ($\sqrt{-1}$). The complex dielectric constant ($\in$) of an optical material can be described by equation (2):

$$\in = \in_1 - i \in_2 \quad (2),$$

where "$\in_1$" is the real part of the complex dielectric constant and "$\in_2$" is the imaginary part. The complex refractive index of a material is related to the complex dielectric constant by equation (3) or equation (4):

$$n_c = \sqrt{\in} \quad (3),$$

or $$\in = n_c^2 \quad (4),$$

which shows that if $n_c$ is complex, $\in$ must be complex. Thus, the dielectric constant, the refractive index, and the extinction coefficient of an optical material are related according to equation (5):

$$\in = (n - ik)^2 = n^2 - k^2 - i \cdot 2nk \quad (5).$$

By controlling a ratio of the refractive index (n) and the extinction coefficient (k) of a material, the transmissivity and the reflectivity of the material also can be controlled. Thus, by controlling a ratio of the refractive index (n) and the extinction coefficient (k) of the composition of silver oxides of AgNWs of a transparent conductive coating, the transmissivity and the reflectivity of the coating, and hence the transparent conductor comprising the coating, also can be controlled.

The inventors have learned that the transmissivity and reflectivity of AgNWs can be controlled by forming on or within surfaces of the AgNWs a silver oxide complex that has a predetermined ratio of refractive index divided by the extinction coefficient (n:k). In turn, the inventors have learned that the predetermined ratio n:k of the silver oxide complex may be achieved, at least in part, by the concentration of silver oxides of the silver oxide complex. In particular, and as described in more detail below, by controlling the concentration ratio of silver oxide (AgO) and di-silver oxide ($Ag_2O$) of the silver oxide complex on the AgNWs, a silver oxide complex can be formed with a predetermined ratio n:k and, thus, the transmissivity and reflectivity of the transparent conductive coating may be controlled and/or improved.

A transparent conductor 100 in accordance with an exemplary embodiment of the present invention is illustrated in FIG. 1. The transparency of a transparent conductor may be characterized by its light transmittance (defined by ASTM D1003), that is, the percentage of incident light transmitted through the conductor and its surface resistivity. Electrical conductivity and electrical resistivity are inverse quantities. Very low electrical conductivity corresponds to very high electrical resistivity. No electrical conductivity refers to electrical resistivity that is above the limits of the measurement equipment available. In one exemplary embodiment of the invention, the transparent conductor 100 has a total light transmittance of no less than about 50%. In another exemplary embodiment of the invention, the transparent conductor 100 has a surface resistivity in the range of about $10^1$ to about $10^{12}$ ohms/square (Ω/sq). In another exemplary embodiment of the invention, the transparent conductor 100 has a surface resistivity in the range of about $10^1$ to about $10^3$ Ω/sq. In this regard, the transparent conductor 100 may be used in various applications such as flat panel displays, touch panels, thermal control films, microelectronics, and the like.

The transparent conductor 100 comprises a transparent substrate 102 and a transparent conductive coating 104 overlying the transparent substrate 102. The light transmittance of the transparent substrate 102 can be less than, equal to, or greater than the light transmittance of the transparent conductive coating 104. The transparent conductive coating 104 comprises a plurality of silver nanowires (AgNWs) 106 that are configured in a conductive network. In an optional exemplary embodiment, the transparent conductive component also comprises a medium material 108. The medium material 108 may overlie the AgNWs that are disposed on the substrate 102 or the AgNWs may be dispersed within the medium material. A silver oxide complex is disposed on or within the surfaces 110 of at least a significant portion of the AgNWs. In an exemplary embodiment, the silver oxide complex is formed on or within surfaces of at least about 20% of the AgNWs. In another exemplary embodiment, the silver oxide complex has a selected ratio of its refractive index (n) divided by its extinction coefficient (k) that depends on and/or corresponds to a ratio of the silver oxides of the silver oxide complex. Silver oxides of the silver oxide complex may include $Ag_2O_3$, AgO, $Ag_2O$, and $Ag_3O_4$. However, the concentrations of $Ag_2O_3$ and $Ag_3O_4$ are negligible. Thus, the selected ratio (n:k) is based on a ratio of the concentration of silver oxide ([AgO]) divided by the sum of the concentration of silver oxide and the concentration of di-silver oxide ([AgO]+[$Ag_2O$]), that is, the concentration ratio [AgO]/([AgO]+[$Ag_2O$]). In one exemplary embodiment of the present invention, the refractive index (n) of the silver oxide complex is in the range of about 0.3 to about 2.1. In another exemplary embodiment, the extinction coefficient (k) of the silver oxide complex is in the range of about 0.1 to about 3.6. In yet another exemplary embodiment, the selected ratio (n:k) is in the range of from about 0.3:3.6 (that is, about 0.08) to about 2.1:0.1 (that is, about 21).

Figure 2:
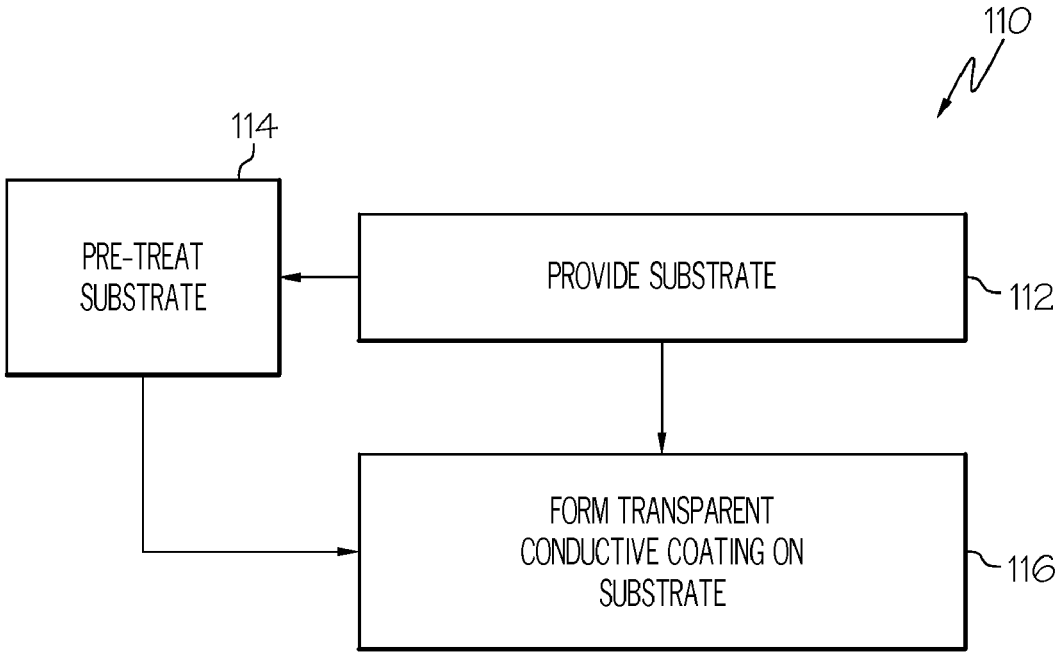
FIG. 2 is a flowchart of a method for fabricating a transparent conductor in accordance with an exemplary embodiment of the present invention.

Referring to FIG. 2, a method 110 for fabricating a transparent conductor, such as the transparent conductor 100 of FIG. 1, comprises an initial step of providing a transparent substrate (step 112). The term "substrate," as used herein, includes any suitable surface upon which the compounds and/or compositions described herein are applied and/or formed. The transparent substrate may comprise any rigid or flexible transparent material. In one exemplary embodiment of the invention, the transparent substrate has a total light transmittance of no less than about 60%. Examples of transparent materials suitable for use as a transparent substrate include glass, ceramic, metal, paper, polycarbonates, acrylics, silicon, and compositions containing silicon such as crystalline silicon, polycrystalline silicon, amorphous silicon, epitaxial silicon, silicon dioxide ($SiO_2$), silicon nitride and the like, other semiconductor materials and combinations, ITO glass, ITO-coated plastics, polymers including homopolymers, copolymers, grafted polymers, polymer blends, polymer alloys and combinations thereof, composite materials, or multi-layer structures thereof. Examples of suitable transparent polymers include polyesters such as polyethylene terephthalate (PET) and polyethylene naphthalate (PEN), polyolefins, particularly the metallocened polyolefins, such as polypropylene (PP) and high-density polyethylene (HDPE) and low-density polyethylene (LDPE), polyvinyls such as plasticized polyvinyl chloride (PVC), polyvinylidene chloride, cellulose ester bases such as triacetate cellulose (TAC) and acetate cellulose, polycarbonates, poly(vinyl acetate) and its derivatives such as poly(vinyl alcohol), acrylic and acrylate polymers such as methacrylate polymers, poly(methyl methacrylate) (PMMA), methacrylate copolymers, polyamides and polyimides, polyacetals, phenolic resins, aminoplastics such as urea-formaldehyde resins, and melamine-formaldehyde resins, epoxide resins, urethanes and polyisocyanurates, furan resins, silicones, casein resins, cyclic thermoplastics such as cyclic olefin polymers, styrenic polymers, fluorine-containing polymers, polyethersulfone, and polyimides containing an alicyclic structure.

In an optional embodiment of the present invention, the substrate may be pretreated to facilitate the deposition of components of the transparent conductive coating, discussed in more detail below, and/or to facilitate adhesion of the components to the substrate (step 114). The pretreatment may comprise a solvent or chemical washing, exposure to controlled levels of atmospheric humidity, heating, or surface treatments such as plasma treatment, UV-ozone treatment, or flame or corona discharge. Alternatively, or in combination, an adhesive (also called a primer or binder) may be deposited onto the surface of the substrate to further improve adhesion of the components to the substrate. Method 110 continues with the formation of a transparent conductive coating, such as transparent conductive coating 104 of FIG. 1, on the substrate (step 116).

Figure 3:
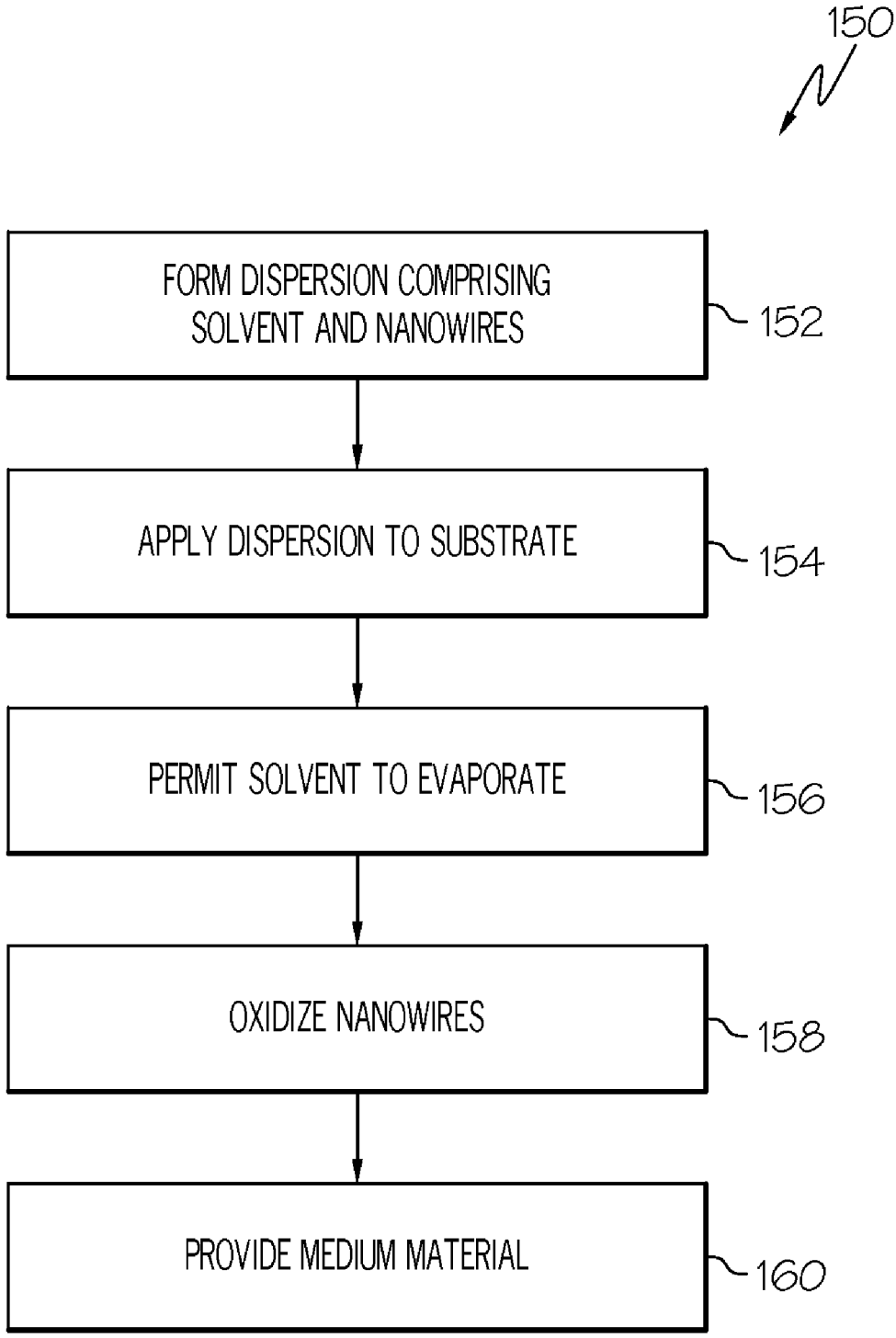
FIG. 3 is a flowchart of a method for fabricating a transparent conductive coating as used in the method of FIG. 2, in accordance with an exemplary embodiment of the present invention.

Referring to FIG. 3, in accordance with an exemplary embodiment of the present invention, the step of forming a transparent conductive coating on a substrate (step 116 of FIG. 2) comprises a process 150 for forming on the substrate a transparent conductive coating with AgNWs having a silver oxide complex. In another exemplary embodiment, the silver oxide complex is formed with a selected concentration ratio $[AgO]/([AgO]+[Ag_2O])$ on or within the surfaces of the AgNWs. Process 150 begins by forming a dispersion (step 152). In one exemplary embodiment, the dispersion comprises at least one solvent and a plurality of AgNWs, such as, for example, those available from Seashell Technology Inc. of La Jolla, Calif. In one exemplary embodiment of the present invention, the AgNWs have an average thickness or diameter in the range of about 40 to about 100 nm. In another exemplary embodiment, the AgNWs have an average length in the range of about 1 μm to about 20 μm. In yet another embodiment, the AgNWs have an aspect ratio of about 100:1 to greater than about 1000:1. As used herein, the term "aspect ratio" means that ratio that characterizes the average nanowire length divided by the average nanowire thickness or diameter. In one exemplary embodiment of the invention, the AgNWs comprise about 0.01% to about 4% by weight of the total dispersion. In a preferred embodiment of the invention, the AgNWs comprise about 0.1 to about 0.6% by weight of the dispersion.

Solvents suitable for use in the dispersion comprise any suitable pure fluid or mixture of fluids that is capable of forming a solution with the AgNWs and that can be volatilized at a desired temperature, such as the critical temperature. Contemplated solvents are those that are easily removed within the context of the applications disclosed herein. For example, contemplated solvents comprise relatively low boiling points as compared to the boiling points of precursor components. In some embodiments, contemplated solvents have a boiling point of less than about 250° C. In other embodiments, contemplated solvents have a boiling point in the range of from about 50° C. to about 250° C. to allow the solvent to evaporate from the applied film. Suitable solvents comprise any single or mixture of organic, organometallic, or inorganic molecules that are volatized at a desired temperature.

In some contemplated embodiments, the solvent or solvent mixture comprises aliphatic, cyclic, and aromatic hydrocarbons. Aliphatic hydrocarbon solvents may comprise both straight-chain compounds and compounds that are branched and possibly crosslinked. Cyclic hydrocarbon solvents are those solvents that comprise at least three carbon atoms oriented in a ring structure with properties similar to aliphatic hydrocarbon solvents. Aromatic hydrocarbon solvents are those solvents that comprise generally three or more unsaturated bonds with a single ring or multiple rings attached by a common bond and/or multiple rings fused together. Contemplated hydrocarbon solvents include toluene, xylene, p-xylene, m-xylene, mesitylene, solvent naphtha H, solvent naphtha A, alkanes, such as pentane, hexane, isohexane, heptane, nonane, octane, dodecane, 2-methylbutane, hexadecane, tridecane, pentadecane, cyclopentane, 2,2,4-trimethylpentane, petroleum ethers, halogenated hydrocarbons, such as chlorinated hydrocarbons, nitrated hydrocarbons, benzene, 1,2-dimethylbenzene, 1,2,4-trimethylbenzene, mineral spirits, kerosene, isobutylbenzene, methylnaphthalene, ethyltoluene, and ligroine.

In other contemplated embodiments, the solvent or solvent mixture may comprise those solvents that are not considered part of the hydrocarbon solvent family of compounds, such as ketones (such as acetone, diethylketone, methylethylketone, and the like), alcohols, esters, ethers, amides and amines. Contemplated solvents may also comprise aprotic solvents, for example, cyclic ketones such as cyclopentanone, cyclohexanone, cycloheptanone, and cyclooctanone; cyclic amides such as N-alkylpyrrolidinone, wherein the alkyl has from about 1 to 4 carbon atoms; N-cyclohexylpyrrolidinone and mixtures thereof.

Other suitable solvents include methylisobutylketone, dibutyl ether, cyclic dimethylpolysiloxanes, butyrolactone, γ-butyrolactone, 2-heptanone, ethyl 3-ethoxypropionate, 1-methyl-2-pyrrolidinone, propyleneglycol methyletheracetate (PGMEA), hydrocarbon solvents, such as mesitylene, toluene di-n-butyl ether, anisole, 3-pentanone, 2-heptanone, ethyl acetate, n-propyl acetate, n-butyl acetate, ethyl lactate, ethanol, 2-propanol, dimethyl acetamide, and/or combinations thereof. Other organic solvents may be used herein insofar as they are able to aid dissolution of an adhesion promoter (if used) and at the same time effectively control the viscosity of the resulting dispersion as a coating solution.

The AgNWs and solvent are mixed using any suitable mixing or stirring process that forms a homogeneous mixture. For example, a low speed sonicator or a high shear mixing apparatus, such as a homogenizer, a microfluidizer, a cowls blade high shear mixer, an automated media mill, or a ball mill, may be used for several seconds to an hour or more, depending on the intensity of the mixing, to form the dispersion. The mixing or stirring process should result in a homogeneous mixture without damage or change in the physical and/or chemical integrity of the AgNWs. For example, the mixing or stirring process should not result in slicing, bending, twisting, coiling, or other manipulation of the AgNWs that would reduce the conductivity of the resulting transparent conductive coating. Heat also may be used to facilitate formation of the dispersion, although the heating should be undertaken at conditions that avoid the vaporization of the solvent. In addition to the AgNWs and the solvent, the dispersion may comprise one or more functional additives. Examples of such additives include dispersants, surfactants, polymerization inhibitors, corrosion inhibitors, light stabilizers, wetting agents, adhesion promoters, binders, antifoaming agents, detergents, flame retardants, pigments, plasticizers, thickeners, viscosity modifiers, rheology modifiers, and photosensitive and/or photoimageable materials.

The method continues by applying the dispersion to the substrate to achieve a selected thickness (step 154). The dispersion may be applied by, for example, brushing, painting, screen printing, stamp rolling, rod or bar coating, ink jet printing, or spraying the dispersion onto the substrate, dip-coating the substrate into the dispersion, slot-die rolling the dispersion onto the substrate, or by any other method or combination of methods that permits the dispersion to be applied uniformly or substantially uniformly to the surface of the substrate. The dispersion may be applied in one layer or in multiple layers to achieve the selected thickness.

The solvent of the dispersion then is at least partially evaporated such that any remaining dispersion has a sufficiently high viscosity so that AgNWs are no longer mobile in the dispersion on the substrate, do not move under their own weight when subjected to gravity, and are not moved by surface forces within the dispersion (step 156). In one exemplary embodiment, the dispersion may be applied by a conventional rod coating technique and the substrate can be placed in an oven, optionally using forced air, to heat the substrate and dispersion and thus evaporate the solvent. In another example, the solvent can be evaporated at room temperature (15° C. to 27° C.). In another example, the dispersion may be applied to a heated substrate by airbrushing the precursor onto the substrate at a coating speed that allows for the evaporation of the solvent. If the dispersion comprises a binder, an adhesive, or other similar polymeric compound, the dispersion also can be subjected to a temperature that will cure the compound. The curing process can be performed before, during, or after the evaporation process.

After at least partial evaporation of the solvent from the dispersion, the AgNWs are oxidized so that a silver oxide complex is formed on or within surfaces of at least a significant portion of the AgNWs (step 158). In one exemplary embodiment, a silver oxide complex is formed on or within the surfaces of at least about 20% of the AgNWs. In another exemplary embodiment, the oxidation is performed so that the silver oxides are present in the silver oxide complex in a selected concentration ratio $[AgO]/([AgO]+[Ag_2O])$ that results in or corresponds to a predetermined or selected ratio (n:k). In this regard, a transparent conductive coating with a desired transmissivity and reflectivity can be achieved. In an exemplary embodiment, the AgNWs are oxidized using a plasma treatment. In one exemplary embodiment, suitable plasma treatment conditions include about 250 mTorr of $O_2$ at 100 to 250 watts for about 30 seconds to 20 minutes in a commercial plasma generator, such as, for example, a PE II-A Planar Etch Plasma System available from Technics West Inc. of San Jose, Calif. In another exemplary, the AgNWs are oxidized by subjecting them to a thermal treatment in an oxygen environment.

In an optional embodiment, after oxidation of the nanowires, a medium material having a transmissivity of at least 60% then is provided overlying the oxidized AgNWs to a selected thickness (step 160). The medium material may comprise one material layer or may comprise more than one layer, each comprising the same or different materials. In one exemplary embodiment, the medium material comprises a gas such as, for example, air. In another exemplary embodiment, the medium material may comprise any of the materials described above that are suitable for use as the substrate.

Figure 4:
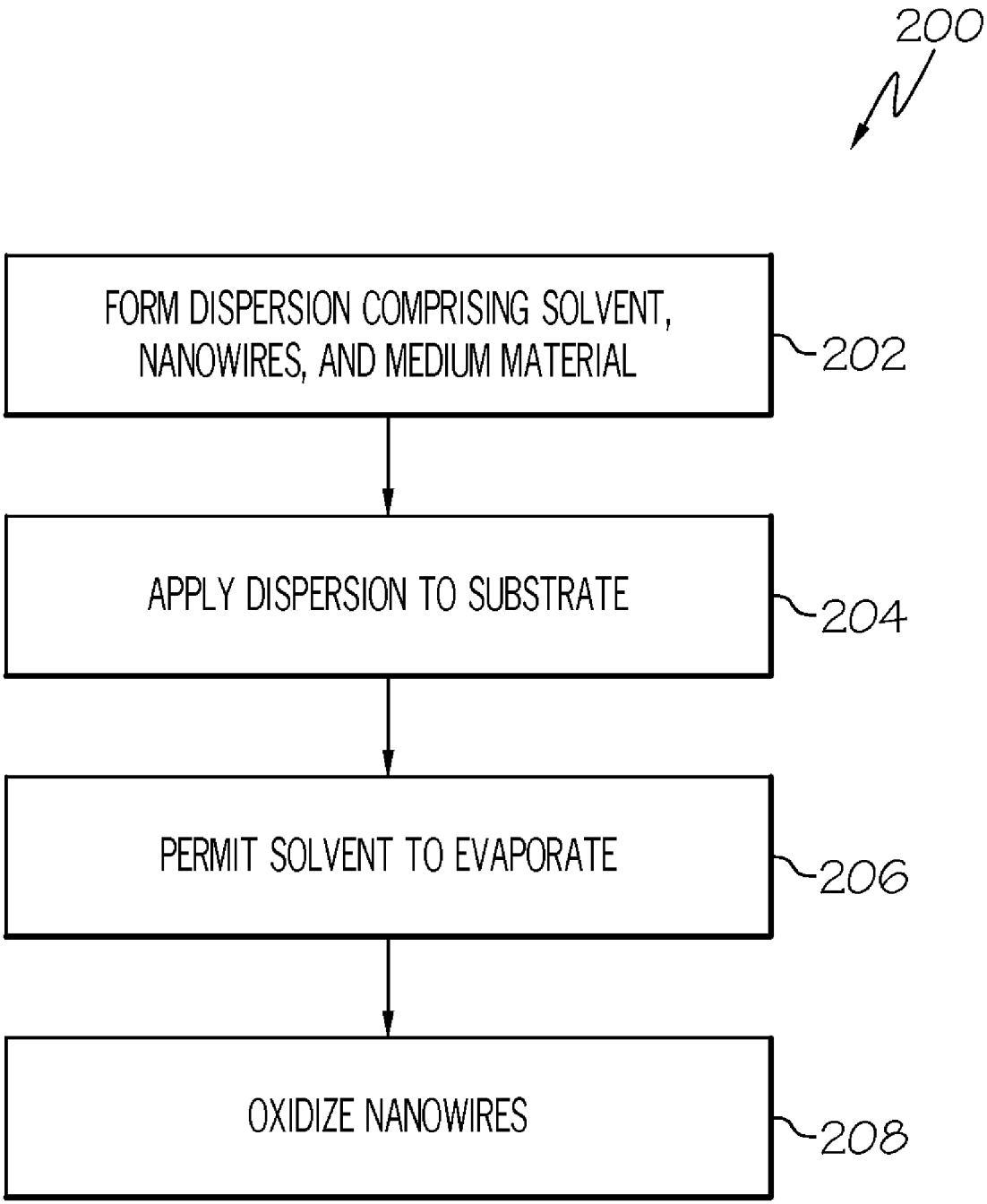
FIG. 4 is a flowchart of a method for fabricating a transparent conductive coating as used in the method of FIG. 2, in accordance with another exemplary embodiment of the present invention.

Referring to FIG. 4, in accordance with an alternative exemplary embodiment of the present invention, the step of forming a transparent conductive coating on a substrate (step 116 of FIG. 2) comprises a process 200 for forming a transparent conductive coating in which the AgNWs are interspersed within the medium material, which is then deposited on the substrate. Process 200 begins by forming the dispersion (step 202). In one exemplary embodiment, the dispersion comprises at least one solvent, the plurality of AgNWs, and the medium material. The solvent may comprise any of the solvents described above with respect to FIG. 3, and the AgNWs may comprise any of the AgNWs described above with respect to FIG. 3. The medium material may comprise any of the medium materials described above with respect to FIG. 3 that are oxygen absorbent, except for air. The dispersion may be mixed using any of the methods described above with respect to step 152 of method 150.

The dispersion then is applied to the substrate to a selected thickness (step 204). The dispersion may be applied by, for example, brushing, painting, screen printing, stamp rolling, rod or bar coating, ink jet printing, or spraying the dispersion onto the substrate, dip-coating the substrate into the dispersion, slot-die rolling the dispersion onto substrate, or by any other method or combination of methods that permits the dispersion to be applied uniformly or substantially uniformly to the surface of the substrate. The dispersion may be applied in one layer or may be applied in multiple layers overlying the substrate.

The solvent of the dispersion then is permitted to at least partially evaporate so that the dispersion has a sufficiently high viscosity so that the AgNWs are no longer mobile in any remaining dispersion on the substrate, do not move under their own weight when subjected to gravity, and are not moved by surface forces within the dispersion (step 206). In one exemplary embodiment, the substrate may be placed in an oven, optionally using forced air, to heat the substrate and dispersion and thus evaporate the solvent. In another example, the solvent may be evaporated at room temperature (15° C. to 27° C.). In another example, the dispersion may be applied to a heated substrate by airbrushing the precursor onto the substrate at a coating speed that allows for the evaporation of the solvent. If the medium material is to be cured, and/or if dispersion comprises a binder, an adhesive, or other similar polymeric compound, the dispersion also may be subjected to a temperature that will cure the compound. The curing process may be performed before, during, or after the evaporation process.

The AgNWs then are oxidized so that a silver oxide complex is formed on or within surfaces of at least a significant portion of the AgNWs (step 208). In an exemplary embodiment, the silver oxide complex is formed on or within surfaces of at least about 20% of the AgNWs. In another exemplary embodiment, the oxidation is performed so that the silver oxide complex has a selected concentration ratio $[AgO]/([AgO]+[Ag_2O])$ that results in a predetermined or selected ratio (n:k). In one exemplary embodiment, the AgNWs are oxidized using a plasma treatment under conditions that permit oxygen to diffuse through the medium material to the AgNWs. In another exemplary, the AgNWs are oxidized by subjecting them to a thermal treatment in an oxygen environment under conditions that permit oxygen to diffuse through the medium material to the AgNWs.

Accordingly, transparent conductors having transparent conductive coatings with controlled or improved transmissivity, reflectivity and conductivity are provided. In one exemplary embodiment, the transparent conductive coatings comprise silver nanowires with silver oxide complexes formed thereon and/or therein. In another exemplary embodiment, the silver oxide complexes exhibit predetermined ratios of refractive indices divided by extinction coefficients. These predetermined ratios are achieved by forming the complexes with predetermined concentration ratios of the concentration of silver oxide divided by the sum of the concentrations of silver oxide and di-silver oxide ([AgO]/([AgO]+[$Ag_2O$]). In addition, methods for fabricating such transparent conductors have been provided. While at least one exemplary embodiment has been presented in the foregoing detailed description of the invention, it should be appreciated that a vast number of variations exist. The foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

What is claimed is:

1. A transparent conductor comprising:

a substrate; and a transparent conductive coating disposed overlying the substrate, wherein the transparent conductive coating comprises a plurality of silver nanowires, at least a portion of which has a silver oxide complex formed on or within surfaces thereof.

2. The transparent conductor of claim 1, wherein at least about 20% of the plurality of silver nanowires has the silver oxide complex formed on or within surfaces thereof.

3. The transparent conductor of claim 1, wherein the silver oxide complex has a refractive index (n) and an extinction coefficient (k), and wherein the silver oxide complex has a selected ratio (n:k) of the refractive index to the extinction coefficient that is determined, at least in part, by a predetermined concentration ratio of a concentration of silver oxide divided by a sum of the concentration of silver oxide and a concentration of di-silver oxide ([AgO]/([AgO]+[$Ag_2O$])) of the silver oxide complex.

4. The transparent conductor of claim 3, wherein the refractive index (n) of the silver oxide complex is in the range of about 0.3 to about 2.1.

5. The transparent conductor of claim 3, wherein the extinction coefficient (k) of the silver oxide complex is in the range of about 0.1 to about 3.6.

6. The transparent conductor of claim 3, wherein the selected ratio (n:k) is in the range of from about 0.08 to about 21.

7. A method for fabricating a transparent conductor, the method comprising the steps of:

providing a substrate; and forming a transparent conductive coating comprising silver nanowires overlying the substrate, wherein the silver nanowires have silver oxides on or within surfaces of the silver nanowires.

8. The method of claim 7, wherein the step of forming comprises the step of forming the transparent conductive coating such that the silver oxides are present in a silver oxide complex having a concentration ratio of a concentration of silver oxide ([AgO]) divided by a sum of the concentration of silver oxide and a concentration of di-silver oxide ([AgO]+[$Ag_2O$]), and wherein the silver oxide complex exhibits a selected ratio (n:k) of its refractive index (n) divided by its extinction coefficient (k) that corresponds to the concentration ratio.

9. The method of claim 8, wherein the step of forming a transparent conductive coating comprises the step of forming the transparent conductive coating such that the refractive index (n) of the selected ratio (n:k) is in the range of about 0.3 to about 2.1.

10. The method of claim 8, wherein the step of forming a transparent conductive coating comprises the step of forming the transparent conductive coating such that the extinction coefficient (k) of the selected ratio (n:k) is in the range of about 0.3 to about 3.6.

11. The method of claim 8, wherein the step of forming a transparent conductive coating comprises the step of forming the transparent conductive coating such that the selected ratio (n:k) is in the range of about 0.08 to about 21.

* * * * *